United States Patent [19]

Williams

[11] Patent Number: 4,671,022

[45] Date of Patent: Jun. 9, 1987

[54] BATHTUB ABRADING SYSTEM

[76] Inventor: David R. Williams, 3232 Villanova Dr., Dallas, Tex. 75225

[21] Appl. No.: 646,054

[22] Filed: Aug. 31, 1984

Related U.S. Application Data

[62] Division of Ser. No. 412,826, Aug. 30, 1982, Pat. No. 4,470,226.

[51] Int. Cl.[4] ..... B24C 9/00

[52] U.S. Cl. ..... 51/410; 51/262 R; 51/310; 318/640; 118/505

[58] Field of Search ..... 51/262 R, 310–312, 51/165.72, 165.74, 410, 416; 200/47; 318/640; 116/202, 230; 118/504, 505

[56] References Cited

U.S. PATENT DOCUMENTS

| | | | |
|---|---|---|---|
| 1,413,060 | 4/1922 | Roberts . | |
| 1,664,159 | 3/1928 | Chase | 51/410 |
| 1,831,535 | 11/1931 | Juers . | |
| 2,022,587 | 11/1935 | Cunningham . | |
| 2,277,937 | 3/1942 | Shryer . | |
| 2,292,369 | 8/1942 | Gordon . | |
| 2,487,366 | 11/1949 | Penno . | |
| 2,494,773 | 1/1950 | Mead et al. . | |
| 2,509,448 | 5/1950 | Ransburg et al. . | |
| 2,639,751 | 5/1953 | Flaherty | 118/505 |
| 2,688,563 | 9/1954 | Kieffer . | |
| 2,723,498 | 11/1955 | Hastrup et al. . | |
| 2,754,227 | 7/1956 | Ransburg . | |
| 2,770,294 | 11/1956 | Fischer . | |
| 2,847,680 | 8/1958 | Dornack . | |
| 2,953,876 | 9/1960 | Zieber | 51/415 |
| 3,042,171 | 7/1962 | Rose . | |
| 3,275,048 | 9/1966 | Statler et al. . | |
| 3,276,423 | 10/1966 | Triller | 118/504 |
| 3,295,491 | 1/1967 | Cassarno . | |
| 3,307,296 | 3/1967 | Ashworth . | |
| 3,377,749 | 4/1968 | Shumaker . | |
| 3,418,668 | 12/1968 | Anderson et al. . | |
| 3,461,478 | 8/1969 | Taylor . | |
| 3,516,204 | 6/1970 | Kulischenko . | |
| 3,535,758 | 10/1970 | Höet | 51/312 |
| 3,545,996 | 12/1970 | Duncan . | |
| 3,624,966 | 12/1971 | Palmer . | |
| 3,624,967 | 12/1971 | Kamper et al. . | |
| 3,785,898 | 1/1974 | Gerber et al. . | |
| 3,805,453 | 4/1974 | Schmall . | |
| 3,835,482 | 9/1974 | Tersch . | |
| 3,925,935 | 12/1975 | Ricklefs . | |
| 4,036,437 | 7/1977 | Dreher . | |
| 4,041,899 | 8/1977 | Wolfe et al. . | |
| 4,278,045 | 7/1981 | Ahmad . | |

FOREIGN PATENT DOCUMENTS

| | | | |
|---|---|---|---|
| 2523375 | 12/1976 | Fed. Rep. of Germany | 51/165.72 |
| 2409160 | 7/1979 | France | 118/505 |
| 0024838 | 2/1980 | Japan | 51/410 |

OTHER PUBLICATIONS

"Guide to Limit Switches", Rudisill, Product Engineering Nov. 1962.

*Primary Examiner*—Frederick R. Schmidt
*Assistant Examiner*—Robert A. Rose
*Attorney, Agent, or Firm*—Richards, Harris, Medlock & Andrews

[57] ABSTRACT

A portable system (10) for abrading the floor of a bathtub (26) to render it slip resistant. The system contains a portable power unit (12) containing an air compressor providing compressed air to abrading unit (14) via compressed air hose (20) and provides a source of electrical power to an abrading unit (14) via a power cable (18). The abrading unit (14) is adapted to direct a high velocity stream of abrasive particles against the floor of a bathtub through perforations in a particle impervious template (24). The unit (14) which is adapted to travel in the forward direction (indicated by the arrow), has a carriage movable in a direction lateral to the direction of forward travel. An abrading head (38) is supported by and reciprocally movable with a carriage to apply the particle stream in a direction lateral to the direction of forward travel and normal to the bathtub surface. A vacuum unit (16) is connected to a filter-hopper (40) mounted on top of the abrading unit for exhausting spent abrasive particles, filtering them and recycling them for further use. A control mechanism is provided for selectively advancing the unit in a forward direction or causing the abrading head to reciprocally traverse the unit in response to the location of perforations in the template.

12 Claims, 7 Drawing Figures

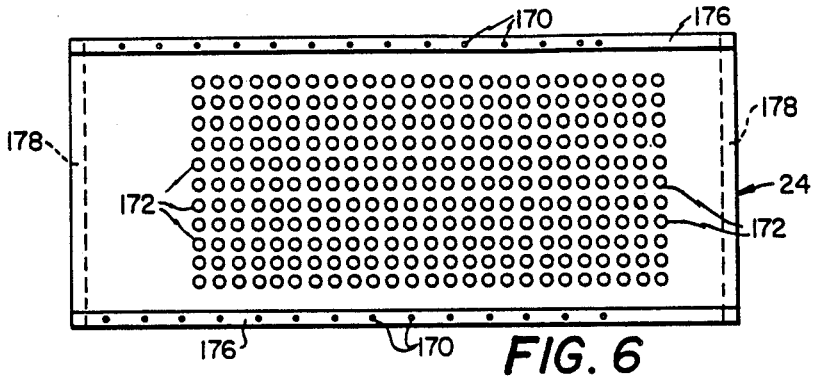
FIG. 6
FIG. 7
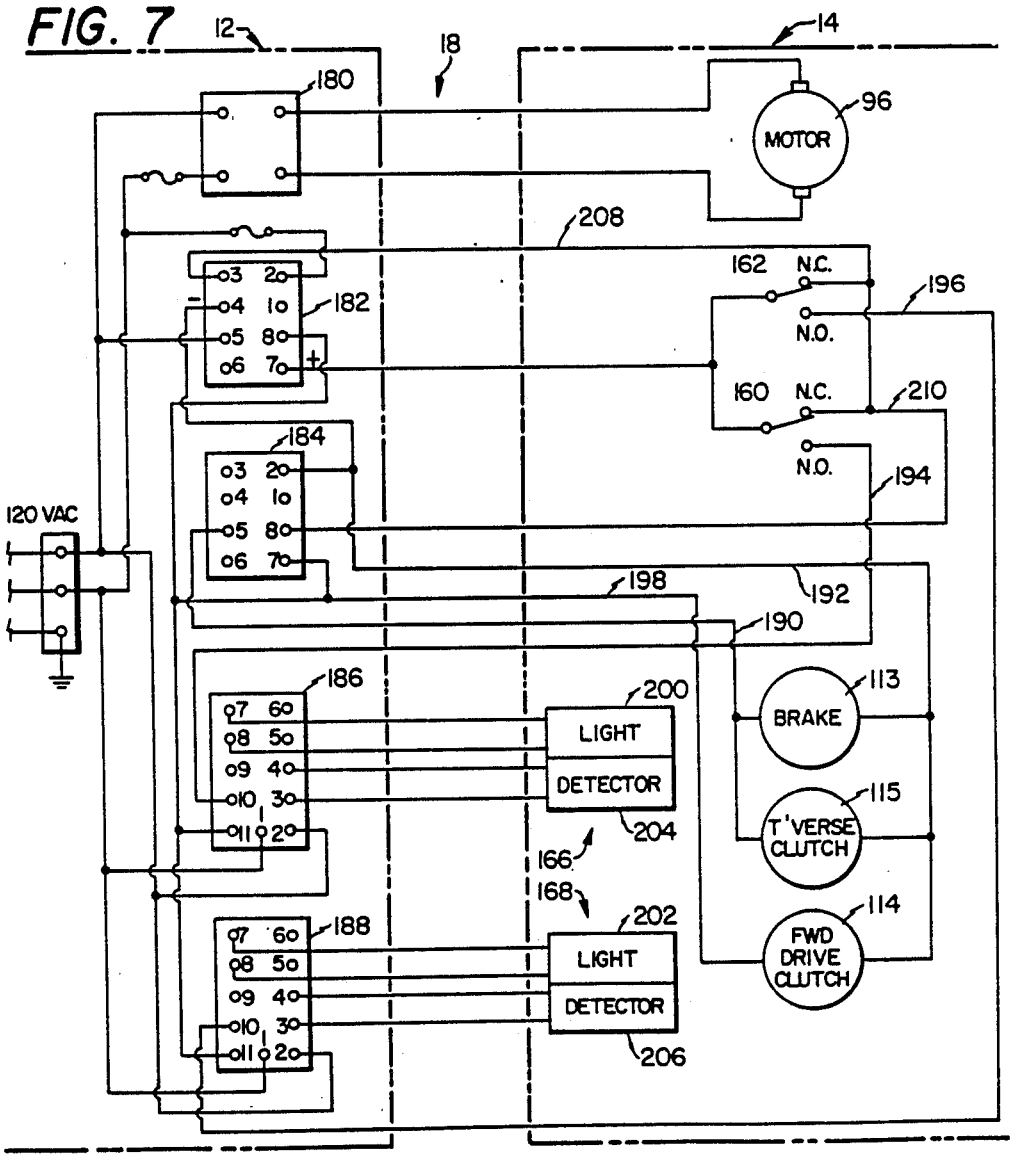

BATHTUB ABRADING SYSTEM

This is a division of application Ser. No. 412,826, filed Aug. 30, 1982, now U.S. Pat. No. 4,470,226, issued 9/11/84.

TECHNICAL FIELD

The invention pertains to the abrasion of surfaces with a stream of abrasive particles, and more particularly to a system for abrading bathtubs to make them slip resistant.

BACKGROUND OF THE INVENTION

Early attempts, using portable systems to abrade installed bathtubs to render them slip resistant, have met with limited success. These machines cause a stream of fine abrasive particles to be impinged at high velocity against a stenciled rubber template placed in the bottom of the tub. This template defines the pattern to be etched on the bottom of the tub.

Previous machines have lacked the features to automatically maintain the abrading particle stream normal to and in proper registration with the selected areas to be abraded. These machines also lacked the capability to produce an infinitely varied abraded pattern.

Accordingly, a portable, automatic abrading machine is needed which will provide the capabilities lacking in the earlier machines.

SUMMARY OF THE INVENTION

The present invention provides an apparatus for abrading a surface via a template containing perforations corresponding to the area of the surface to be abraded. The present invention maintains proper registration between the abrasive particle stream and perforations in the template, positions the particle stream normal to the surface at all times and can produce an infinite variety of abraded patterns.

According to one aspect of the present invention, an abrading machine, adapted to travel in a forward direction, contains a carriage movable in a direction lateral to the direction of travel. The machine includes a drive means, a first shaft rotatably mounted in the machine and capable of being mechanically connected to the drive means via a traverse clutch means for selectively connecting the drive means to the first shaft. The first shaft contains a pair of oppositely directed helical camming grooves. A sliding nut connected to the carriage engages one at a time of the helical threads to translate the rotation of the first shaft into linear reciprocal motion of the carriage. The carriage supports an abrading head having means for fluidizing abrasive particles into a particle stream and a nozzle means for directing the particle stream to the surface to be abraded. A second shaft having a pair of wheels connected at opposite ends thereof is rotatably mounted in the machine. A forward-drive clutch may be selectively activated for interconnecting the drive means with the second shaft to enable the machine to travel in the forward direction. A control means responsive to reflective spots on the margins of the template is connected to both clutches to selectively activate one or the other clutch to enable the machine to travel in the forward direction or to enable the carriage to traverse the surface to be abraded in a direction lateral to the direction of forward travel. The carriage includes upper and lower trunnions disposed in a vertically-spaced relation, adapted to support the abrading head. The upper trunnion is rigidly connected to the carriage, while the lower trunnion is pivotally connected to the carriage to render the abrading head positioned therein pivotable with respect to the fore and aft axis of the upper trunnion. A first pair of flatly cammed surfaces is disposed perpendicular to the direction of forward travel to support the upper trunnion as the carriage traverses the machine. A second pair of cammed surfaces is disposed perpendicular to the direction of forward travel to support the lower trunnion as the carriage traverses the machine. The second pair of cammed surfaces is dimensioned to represent the transverse contour of the surface to be abraded such that the abrading head and nozzle are directed substantially normal to the surface to be abraded as the carriage traverses the first shaft.

According to another aspect of the present invention, a portable system for abrading a surface is provided. The system includes a source of compressed air, a source of electric power, a supply of abrasive particles, a template and an abrading machine adapted to traverse the template which is disposed over the surface to be abraded. The template, which is impervious to the particle stream, contains perforations for exposing selected areas of the surface to be abraded to the particle stream. The machine is adapted to travel in the forward direction and contains a carriage movable in a direction lateral to the direction of forward travel to permit the stream of abrasive particles to be applied to the surface in a direction lateral to the direction of forward travel. The lower trunnion of the carriage is adapted to support an abrading head connected to the source of compressed air, to the supply of abrasive particles and to a vacuum source. The head includes means for fluidizing the abrasive particles into a particle stream and a nozzle for directing the particle stream to the surface to be abraded. The machine also includes a drive means connected to the electric power source, a first shaft rotatably mounted in the machine and having a pair of helical camming grooves formed therein, and a traverse clutch capable of being selectively activated to interconnect the drive means with the first shaft. A second shaft is rotatably mounted in the abrading machine and connected to a pair of wheels at opposite ends thereof. A forward drive clutch is selectively activated to interconnect the drive means with a second shaft to permit the machine to travel in the forward direction. The carriage is connected to a cylindrical nut slidably disposed along the first shaft for engaging one at a time of the helical threads to translate rotational movement of the first shaft into linear reciprocal movement of the carriage. A control means for the traverse and forward drive clutches is provided for selectively activating one of the clutches and deactivating the other clutch. The control means includes a pair of oppositely-positioned, two-pole limit switches which are alternately actuated by the extreme traverse of the carriage in one, and then the other, lateral directions of travel. Each limit switch is series-connected to a separate, photoelectrically-controlled, normally-closed switch. Each photoelectric switch is controlled by an individual sensor. The sensors are laterally positioned on either side of the abrading machine to detect reflected light from the margins of the underlying template.

Actuation of a particular limit switch is synchronized to cause a current to flow through the associated, normally-closed, photoelectric switch. This current disengages the traverse clutch and simultaneously engages the forward-drive clutch. Forward movement is stopped when the associated sensor detects reflected light from the margin of the template at a location corresponding to the next lateral row of perforations in the template. At this new forward position, the forward-drive clutch is disengaged, and the traverse clutch is simultaneously engaged.

BRIEF DESCRIPTION OF THE DRAWINGS

For a more complete understanding of the present invention and for other obvious advantages thereof, reference is now made to the following Description of the Preferred Embodiment, taken in conjunction with the accompanying Drawings in which:

FIG. 6 is a plan view of the template shown in FIG. 1; and

FIG. 7 is a schematic diagram of the electrical circuitry of the abrading system shown in FIG. 1.

DESCRIPTION OF THE PREFERRED EMBODIMENT

Figure 1:
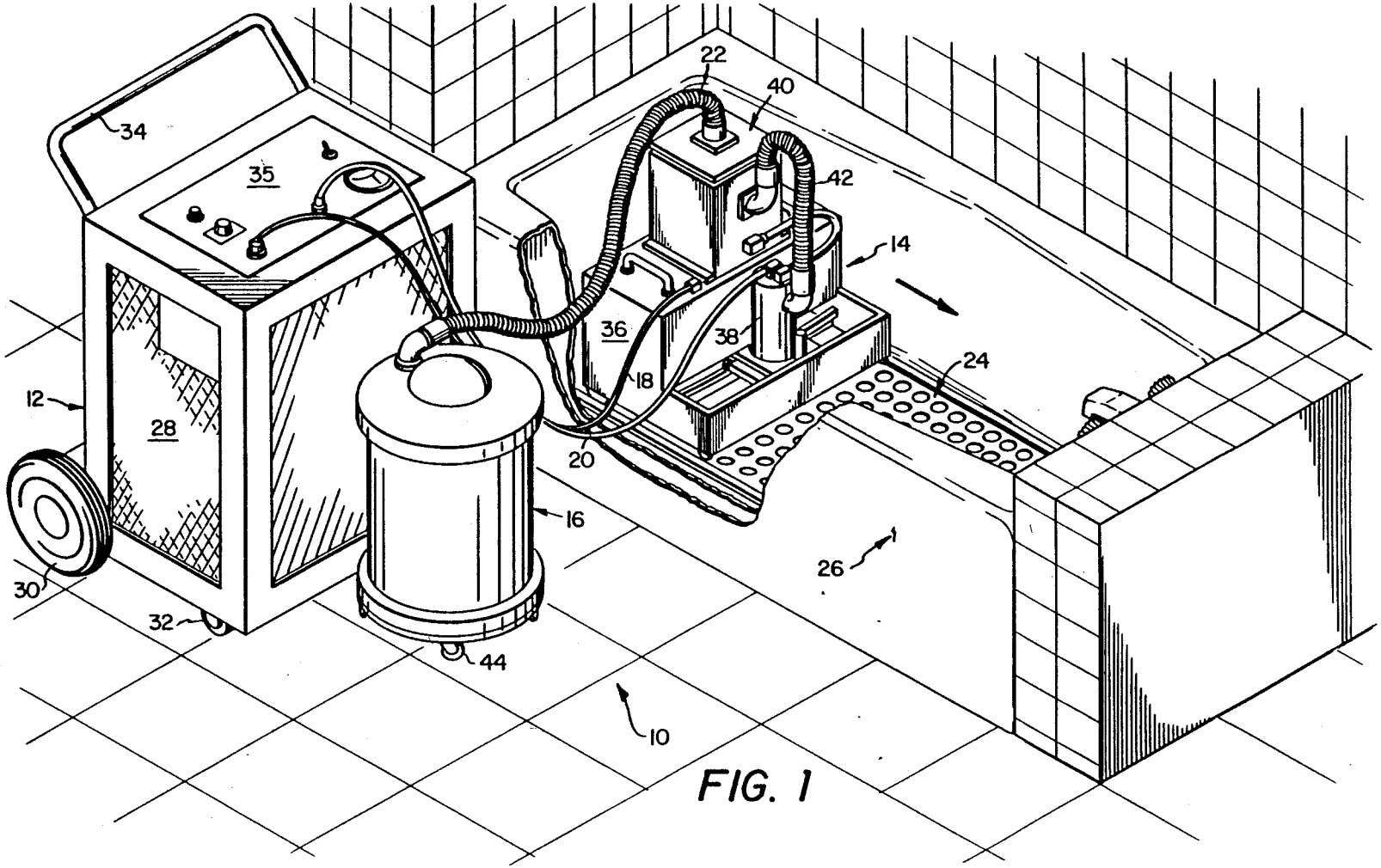
FIG. 1 is a perspective view of the abrading system of the present invention with a portion of the bathtub wall broken away to illustrate the operation of the invention.

FIG. 1 illustrates the abrading system 10 of the present invention for impinging a high velocity fluidized stream of abrasive particles against porcelain or other surface to be abraded. The system 10 includes a portable power unit 12, an abrading unit 14 and a portable vacuum unit 16. Abrading unit 14 is electrically controlled from power unit 12, as described below in greater detail, through a power cable 18. Compressed air is also provided by power unit 12 to abrading unit 14 via air hose 20. Vacuum unit 16 is connected to the abrading unit 14 by an exhaust hose 22 to facilitate the withdrawal and recovery of spent abrasive particles and the withdrawal and collection of porcelain dust, as described below in greater detail.

As shown in FIG. 1, the abrading system 10 is typically used in connection with a template 24 in a bathtub 26 or on another surface to be abraded. It will be appreciated, however, that there may be some applications where a surface is to be completely and not selectively abraded and where template 24 will not be required.

Portable power unit 12 is constructed as a rectangular steel casing 28 mounted on two pairs of wheels 30 and 32 with wheels 32 being mounted in swivel casters. A handle 34 is connected at the upper end of unit 12 to facilitate movement of the unit to a desired site. Unit 12 contains an air compressor and dryer (neither is shown), as well as electrical circuitry (FIG. 7) for powering the abrading unit 14. The dryer provides dry air, which helps to maintain the fineness and separation of the abrasive particles in the fluid stream. The compressor provides a source of pressurized air necessary to impart momentum to the abrasive particles entrained therein. In addition, a control panel 35 is also provided on the top of unit 12 to permit the operator to control various features of the system.

Abrading unit 14 includes a chassis 36, which is longitudinally driven in the manner hereafter described to intermittently advance the unit 14 to the next row of perforations in template 24 when the abrading head 38 has traversed the width of chassis 36 and the perforated width of the template 24. Head 38 reciprocally traverses the template by operation of a ball reversal screw 122 (FIG. 3), which causes abrading head 38 to reverse direction at either extreme of its lateral travel. As hereafter described, head 38 provides a stream of high velocity, fluidized abrasive particles which are directed against the template 24 in bathtub 26 to abrade the surface of the bathtub 26 through the stenciled perforations in the template 24. The top of the chassis 36 contains a filter-hopper means 40, in which spent particles are collected, filtered and recirculated. Head 38 is operatively connected to filter-hopper means 40 via hose 42.

Vacuum unit 16 is a conventional, industrial or institutional vacuum cleaner mounted on wheels 44 for portability. Unit 16 is connected to a conventional electrical power source (not shown) and provides a source of negative (or vacuum) pressure needed for filtering and recirculating the spent abrasive particles.

Figure 2:
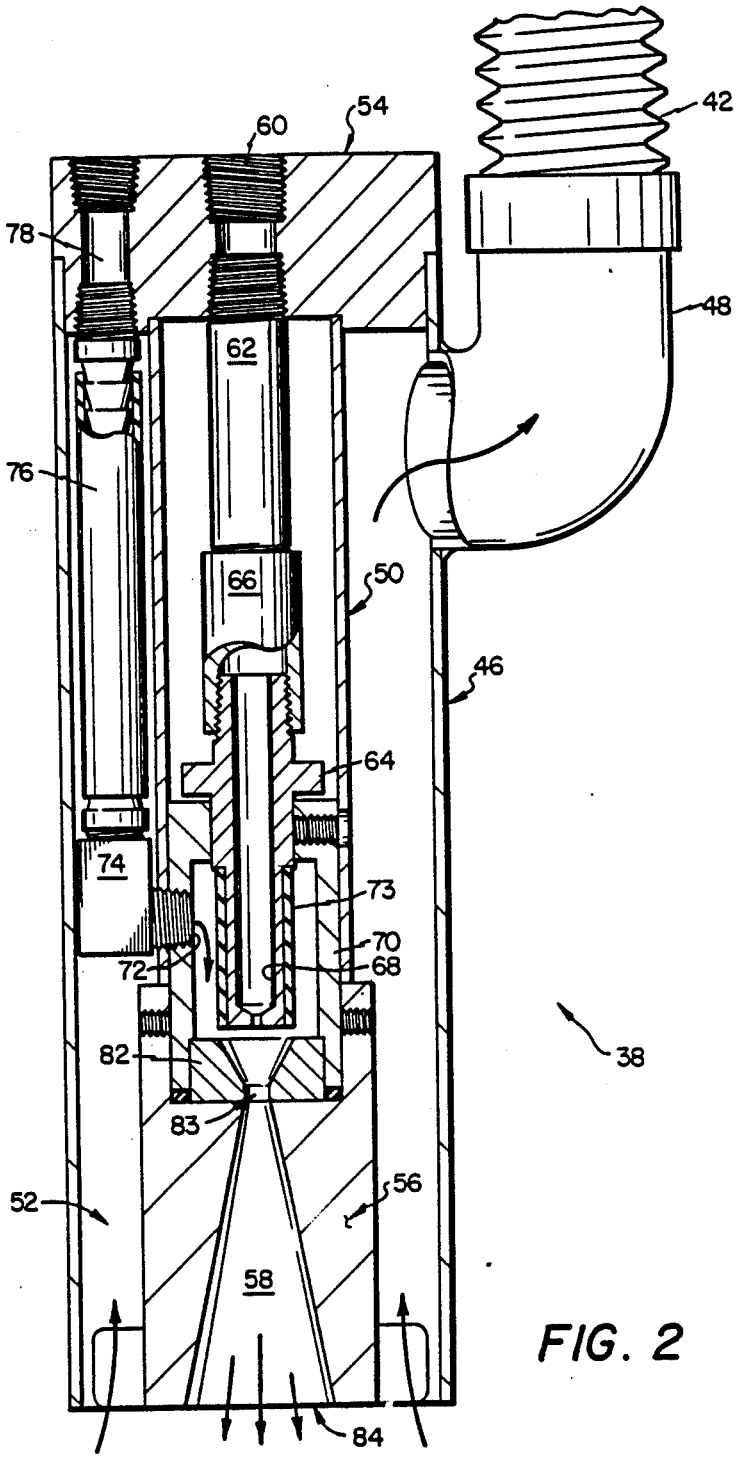
FIG. 2 is a section view of the abrading head of the abrading system shown in FIG. 1.
Figure 4:
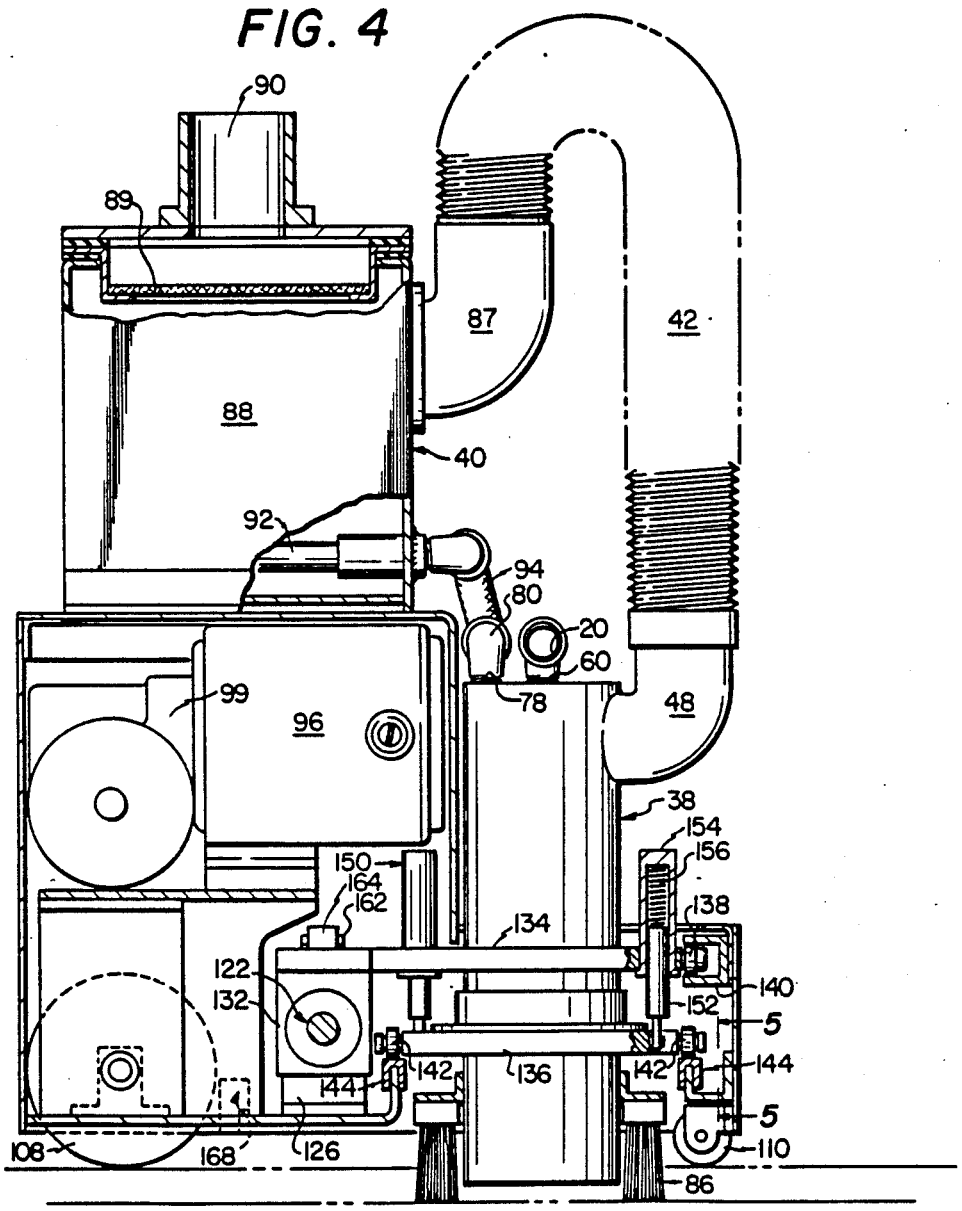
FIG. 4 is a side section view of the abrading unit shown in FIGS. 1 and 3.

FIG. 2 illustrates the construction of abrading head 38. Abrading head 38 contains an outer sleeve 46, having a vacuum hose connection 48, connected thereto, with an inner sleeve 50 concentrically mounted within the outer sleeve 46 to to form an annular chamber 52. Chamber 52 is closed at the upper end of the outer sleeve 46 by a circular member 54, thereby diverting the flow of spent abrasive particles and dust through vacuum hose connection 48 into filter-hopper means 40 (FIGS. 1 and 4).

The upper end of the inner sleeve 50 is connected to the circular member 54 and the lower end of the sleeve is connected to a diffuser member 56 which contains a diverging frustoconical bore 58 for diffusing the stream of abrasive particles produced within the inner sleeve 50. An interiorly threaded compressed air inlet 60, formed in circular member 54, communicates with a concentrically disposed nipple 62, which is threadedly connected to air inlet 60. The lower end of nipple 62 is mechanically coupled to an air nozzle 64 by means of coupling 66. Air nozzle 64, which has a relatively narrow internal bore 68 compared with nipple 62, is positioned in the well of an injector body 70 through which abrading particles are fed via a port 72 in the side wall of the body. Since a portion of air nozzle 64 is exposed to impinging particles from port 72, a rubber sleeve 73 is provided on the lower portion of nozzle 64 to protect the nozzle. Port 72 is internally threaded to receive an L-member 74 which is connected via a hose 76 to an internally threaded abrasive inlet 78 in circular member 54. Air inlet 60 is connected to a compressed air hose 20, and abrasive inlet 78 is connected, via fitting 80 (FIG. 4), to abrasive hose 94 (FIG. 3) from filter-hopper means 40 to supply compressed air and abrasive particles, respectively, to the abrading head 38.

As best seen in FIG. 2, compressed air furnished to nipple 62 via air inlet 60 passes through the internal bore 68 of air nozzle 64 and discharges at increased velocity and reduced pressure into an injector body 70. Abrasive particles, such as silicon carbide, or other particles suitable for the particular application, are aspirated through inlet 78 to the injector body 70 via hose 76, L-member 74 and out through port 72. The abrasive particles are entrained into a high velocity stream at the exit end of air nozzle 64 and enter a converging air and abrasive nozzle 82 positioned between injector body 70 and diffuser member 56. The air and abrasive nozzle 82 communicates directly with the diverging frustoconical bore 58 of diffuser member 56 forming a venturi 83 in which the abrasive particles are mixed in the air stream, and the particles are ejected into bore 58 at higher velocity. The beamwidth of the pressurized particle stream diverges to a desired size in diverging bore 58 and the stream is discharged at aperture 84.

After the abrasive particles impinge the surface to be abraded and/or the template 24, depending upon the application, the spent particles and dust are evacuated through annular chamber 52, through connection 48 and hose 42 to filter-hopper means 40 (FIG. 1) for filtering and recirculation. As previously mentioned, negative vacuum pressure necessary to exhaust the spent particles is supplied by vacuum unit 16 through filter-hopper means 40 (FIG. 1). Spent particles are generally confined within the perimeter of outer sleeve 46 by an annular brush 86 (FIG. 4) which encircles the outer sleeve and which makes contact with the template 24 or surface to be abraded.

Figure 3:
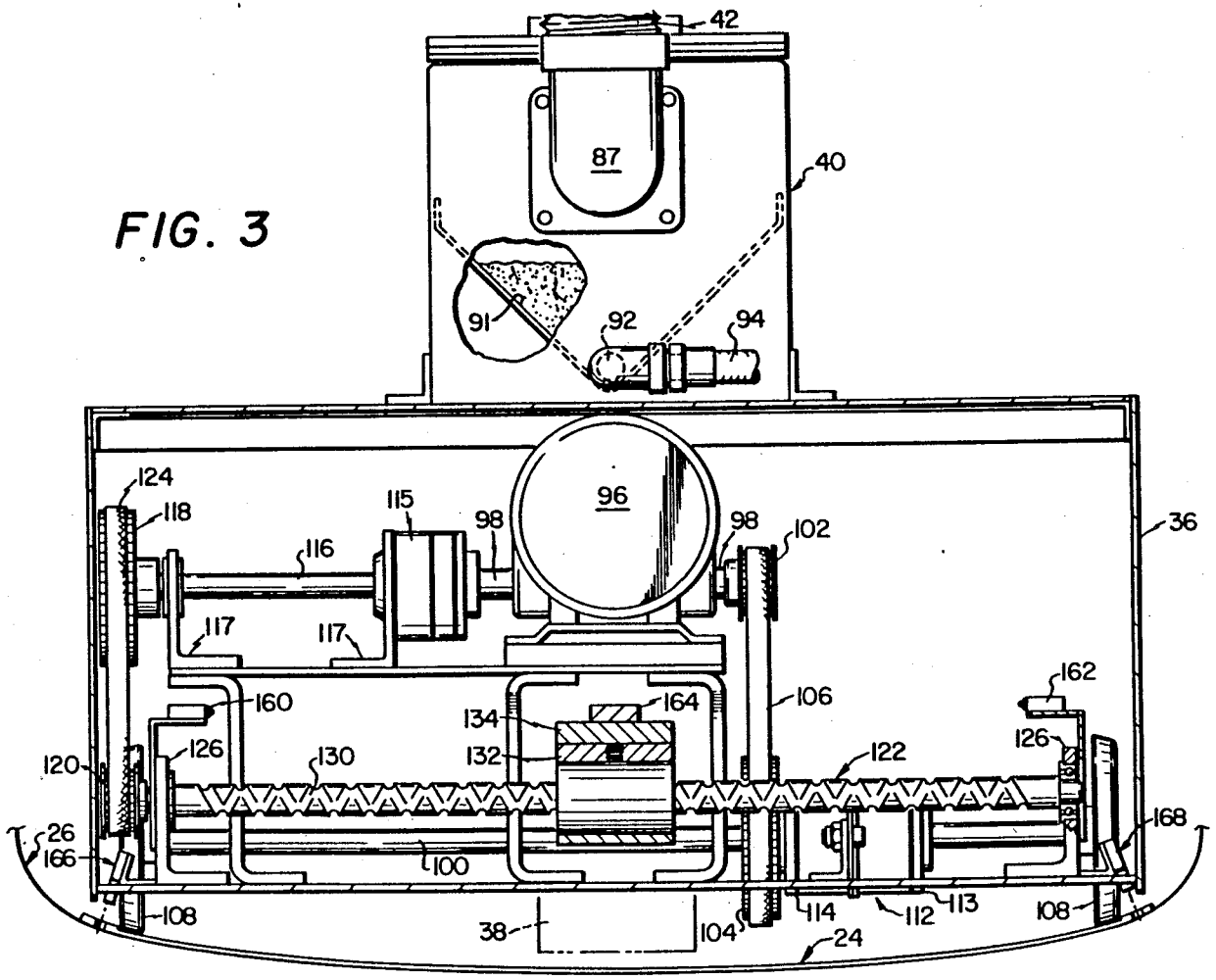
FIG. 3 is a frontal section elevation view of the inside of the chassis of the abrading unit shown in FIG. 1.

FIGS. 3 and 4 illustrate the details of the filtering and recirculation system. Hose 42 (FIG. 4), pivotally connected to connection 48, conducts the spent abrasive particles and dust from abrasive head 38 to filter-hopper means 40 at connector 87. As best seen in FIG. 4, spent particles are evacuated into a reservoir 88 of filter-hopper means 40, the upper portion of which contains a filter 89, having a mesh sufficiently fine to trap the abrasive particles in reservoir 88, but to pass dust, dirt and other particles into port 90. Port 90 is pivotally connected to exhaust hose 22 (FIG. 1), which exhausts dust to the vacuum unit 16 for collection. A hopper 91 (FIG. 3) may be provided in reservoir 88 to facilitate the collection of abrasive particles to be recirculated. A conduit 92 positioned in the bottom of hopper 91 communicates abrasive particles via hose 94 to the abrasive inlet 78 of head 38. External access (not shown) is provided to hopper 91 to permit an initial charge of abrasive particles to be placed in the hopper, or to permit the charge to be replenished from time to time.

The internal elements of the chassis 36 are also illustrated in both FIGS. 3 and 4. An electric motor 96, such as a 1/50 horsepower, variable speed, DC, gear motor type IO-BA-O manufactured by Minarik Electric Company of Los Angeles, Calif., has a double-ended horizontal output shaft 98 driven by motor gear housing 99 (FIG. 4). Motor 96 and shaft 98 are actuated when electric power is applied to the motor via power cable 18 (FIG. 1). Output shaft 98 actuates a drive shaft 100 by means of a pair of pulleys 102 and 104 mounted on shaft 98 and forward-drive clutch 114, respectively, connected by a belt 106. Pulley 104 is sized relative to pulley 102 such that the rotational speed of drive shaft 100 will be reduced by a factor of $\frac{1}{4}$ of motor speed. Drive shaft 100 conveys the forward or longitudinal motion to abrading unit 14 along the template 24. As best seen in FIG. 3, drive shaft 100 is connected to two rear traction wheels 108, located at the rear of the chassis 36, to provide rear-wheel drive. A pair of unpowered front wheels 110 (FIG. 4) is also provided on the forward edge of the chassis to facilitate longitudinal travel. An electromagnetic clutch-brake assembly 112 (FIG. 3) is also provided on drive shaft 100. The clutch-brake assembly 112 contains an electromagnetic brake 113 and a forward-drive clutch 114, which are selectively operated when abrading unit 14 is in the traverse or travel mode, respectively. In the traverse mode, in which the abrading head 38 is traversing the perforated width of the template, the forward-drive clutch 114 is disengaged, and the brake 113 is engaged to lock rear traction wheels 108, thereby preventing longitudinal motion of the unit. In the forward-travel mode, the brake 113 is disengaged and the forward-drive clutch 114 is actuated to permit drive shaft 100 to be driven.

As shown in FIG. 3, one end of output shaft 98 is connected to an electromagnetic traverse clutch 115, which when actuated, permits output shaft 98 to engage a secondary shaft 116 journaled in a pair of bearing supports 117. A pulley 118, mounted to the end of secondary shaft 116, drives a smaller pulley 120, mounted on the end of the ball reversal screw 122 by means of a belt 124. Pulleys 118 and 120 are relatively sized such that rotational movement of the ball reversal screw 122 is increased by a factor of 2.50 of motor speed. When the abrading head 38 is in the traverse mode, traverse clutch 115 is engaged and ball reversal screw 122 is rotated, causing abrading head 38 to traverse the template. When the traverse limit of the ball reversal screw 122 is reached, the system is switched to the travel mode in which the traverse clutch 115 is disengaged, the forward-drive clutch 114 is engaged and brake 113 is disengaged. This stops motion of the ball reversal screw 122 and transverse motion of abrading head 38, permitting the abrading unit 14 to travel forward.

As shown in FIG. 3, the ball reversal screw 122 is journaled in bearing supports 126. Screw 122 may be a conventional ball reversal screw, such as model BRC1733-1 available from Norco International of Ridgefield, Conn., containing a pair of oppositely directed, helically disposed grooves 130. A suitably sized cylindrical nut, engaging the grooves, will travel in one direction until the end of the screw is reached, at which point the nut will then traverse the length of the screw in the opposite direction. As shown in both FIGS. 3 and 4, the cylindrical nut which engages grooves 130 is enclosed in a carriage 132, which reciprocally traverses screw 122 in both lateral directions. Carriage 132 is rigidly connected to an upper trunnion 134 and pivotally connected to a lower trunnion 136, which trunnions retain abrading head 38 and cause it to move in the lateral dimension.

Referring now to FIG. 4, upper trunnion 134 contains a circular aperture having a radius slightly larger than the abrading head 38 to permit pivoting or tilt of the abrading head 38 as it traverses and follows the contour profile of cam surfaces 144. An important feature of the invention is the ability to maintain the abrasive head 38 normal to the contour of the bathtub surface at all times. Since the floor of most, if not all, conventional bathtub bottom surfaces exhibit an increasing contour gradient from the bottom centerline to the sidewall, failure to maintain the abrading head normal to the surface reduces the useful momentum of the abrasive particle stream and frequently results in incomplete or distorted geometric patterns abraded on the bathtub surface. In order to follow the contour of the bathtub, upper trunnion 134 travels horizontally, while the lower trunnion 136 follows the bathtub contour, thereby causing the centerline of abrading head 38 to tilt from the vertical, such that the particle stream is directed normal to the bathtub surface.

As shown in FIG. 4, the trailing edge of upper trunnion 134 is rigidly connected to carriage 132, and the leading edge of the trunnion is fitted with a pair of cam follower bearings 138 that travel in a rectilinear channel guide 140 to facilitate lateral movement of trunnion 134 and carriage 132. Channel guide 140, which provides a rectilinear camming surface, thus limits motion of upper trunnion 134 to a direction perpendicular to the direction of forward travel.

Figure 5:
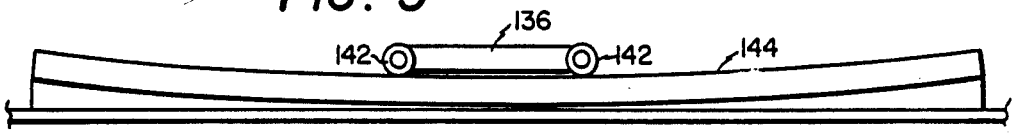
FIG. 5 is a section view of one of the tub-profiled cammed surfaces shown in FIG. 4.

FIGS. 4 and 5 illustrate the lower trunnion 136 and a pair of cam follower bearings 142 on the leading and trailing edges thereof. Cam follower bearings 142 are designed to roll along identical cam surfaces 144. Cam surfaces 144, disposed parallel to channel guide 140 and ball reversal screw 122, are dimensioned and contoured to represent the contour of a particular type of bathtub. Since, for all practical purposes, there are only a limited number of different bathtub contours, various tub contours of major bathtub manufacturers can be represented by a relatively small number of replaceable cam surfaces 144. Since in most applications, the system will be used with a large number of identical tubs, such as in an apartment complex or in a hotel, and since most tubs are made by very few manufacturers, the number of different cam surfaces needed by the user will be relatively small. As carriage 132 and upper trunnion 134 move toward an end of ball reversal screw 122, and cam follower bearings 142 on the lower trunnion 136 follow the contour of cam surfaces 144, lower trunnion 136 is tilted at an angle to the vertical to position the abrading head 38 normal to the tub.

To facilitate the pivoting of the abrading head 38 to follow the contour of the bathtub, upper trunnion 134 is connected to the lower trunnion 136 by a pair of spring biased piston support members 150. Each of the support members 150 includes a piston 152, which is pivotally connected to lower trunnion 136, and the piston is reciprocally movable within a cylinder 154 against a spring 156 contained within the cylinder. Cylinders 154 are rigidly connected to upper trunnion 134, such that lower trunnion 136 can pivot relative to pistons 152 against spring bias provided by springs 156. In traversing the width of the tub, the tilting of head 38 is accompanied by the movement of head 38 in a direction normal to the tub surface, and this movement is reacted by the compression of springs 156 to maintain cam follower bearings 142 in contact with cam surfaces 144.

Referring now to FIGS. 3, 4 and 6, the registration alignment feature of the present invention will now be described. A pair of normally-closed right and left, two-pole, mechanical limit switches 160, 162 are provided, with one switch adjacent each opposite end of the ball reversal screw 122. Switches 160, 162 are opened by an actuator 164, which is connected to carriage 132, when the carriage 132 reaches the right or left extent of the screw 122. Limit switches 160, 162 interact with a pair of LED reflective scanners 166, 168 positioned on the right and left sides of the chassis 36, respectively, to automatically control the operation of the abrading unit in the traverse and travel modes in response to the detection of a reflective spot along the margin of the template indicative of the position of a row of perforations in the template. Each scanner 166, 168 comprises an infrared (or visible) light source which illuminates the template 24 and a photodetector which detects infrared or visible radiation reflected from any reflecting surface encountered.

Referring to FIG. 6, which illustrates template 24, it will be seen that a series of reflecting spots 170 is provided along each margin 176. These spots may be provided by stainless steel rivet heads, pieces of bonded, reflective tape, reflective rubber inserts or small perforations in margins 176, exposing the reflective tub surface against a normally dark background.

The margins 176 of the template may be formed in elevation to guide wheels 108, 110 of the abrading unit on the template. The template may be formed of nonreflecting rubber or other resilient material with any desired configuration of perforations. A magnetic rubber strip 178 may be provided at the leading and trailing edges of the template to reduce slippage of the template on the surface to be abraded. There is a reflective spot corresponding to each lateral row of pattern holes 172, plus three additional reflective spots required for control in starting and stopping the abrading process.

Referring to FIG. 4, it will be seen that the left reflective scanner 168 (166 not shown) is mounted at a position to the rear of the vertical centerline of head 38. Ideally, the scanners 166, 168 would be located laterally adjacent to head 38; however, because the scanners are relatively fragile, added protection is afforded by mounting them in a rearward location.

Referring again to FIG. 6, the effect of the displacement of the scanners 166, 168 to the rear of abrading head 38 is seen in the relationship of reflecting spots 170 to the holes 172 arranged in lateral rows. The extreme left reflecting spot 170 in the top (left) margin provides reflected light to the left scanner 168 which, in turn, generates the electrical pulse to stop forward movement of the machine with head 38 in registration with the first lateral row of holes, this row being located at the extreme left in the pattern.

In performing the abrading process on a bathtub, abrading unit 14 is placed on the extreme left end of the underlying template 24 of FIG. 6. Placement of the machine is done precisely to place the right scanner 166 in position to receive reflected light from the extreme left reflective spot 170 in the bottom (right) margin. Correspondingly, this placement of the machine positions the laterally-opposite left scanner 168 above a dark area of the top (left) margin.

The arrangement of reflective spots in the margins progresses from left to right in an alternately staggered fashion such that a reflective spot is laterally opposite a dark area in the opposite margin. The exception is the relationship of the extreme right reflective spot in each margin, which pair is laterally opposite one another.

Thus, abrading unit 14 is first positioned so that head 38 is centered above the unperforated area of the template, to the left of the first lateral row of pattern holes 172. Two purposes are served by this positioning. First, on starting, the abrasive particle flow rate develops a steady state prior to the machine's advancing to the first lateral row of pattern holes. Secondly, this placement of the machine serves to synchronize the direction of lateral traverse of head 38 with the reflective scanner-controlled switch positions. A control unit for each reflective scanner contains a normally-closed, relay-operated switch. This switch is opened when the associated reflective scanner receives a reflected light signal. At an extreme traverse position of the abrading head, the appropriate traverse limit switch is actuated. Forward advancement of the machine will occur when said limit switch is actuated, provided the reflective scanner on that side of the machine is not receiving a reflected light signal.

Thus, initial placement of the machine positions the right reflective scanner 166 to receive reflected light from the extreme left reflective spot on the bottom (right) margin. The right reflective-scanner-controlled relay switch is open. If, for example, initial traverse of the head is to the right, the machine will not advance at the end of the right-traverse stroke. The machine will remain on station, and the head will reverse direction, proceeding to the left. At the end of the leftward stroke, the left limit switch 162 is actuated, supplying current through the left, reflective-scanner operated, normally-closed relay switch, which current disengages the traverse clutch and simultaneously engages the forward-drive clutch. The machine moves forward and stops the left reflective scanner 168 detects reflected light from the first reflective spot in top (left) margin. Head 38 is now in registration with the first lateral row of pattern holes 172. Abrasion of this row begins as the head proceeds to traverse from left to right. Upon completion of the abrasion of the first row, the right reflective scanner 166 will control the next step advancement of the machine to place head 38 in registration with the second row of holes.

Upon completion of abrasion of the final row of holes, the machine will advance to a final stopping position which places head 38 above an unperforated area at the extreme right end of template 24. There is a pair of laterally-opposite reflective spots corresponding to this final position. Both reflective-scanner-operated relay switches are open, and no further, advancement can occur. The head will continue to traverse in both directions at this station until power to abrading machine 14 is switched off at power unit 12.

FIG. 7 illustrates operation of the present invention by reference to its electrical circuitry. Power unit 12 contains a motor control 180, a rectifier 182, a relay 184 and two identical photoelectric control circuits 186 and 188. A 120 volt AC source is connected to power unit 12. In turn, this input voltage is supplied to motor control 180, rectifier 182 and photoelectric control circuits 186 and 188. Output of the motor control 180 is 90 volts DC, maximum, and can be manually adjusted for lower voltages to control motor speed. Output from rectifier 182 is a constant 90 volts DC to power relay 184, brake 113, forward-drive clutch 114 and traverse clutch 115. Photoelectric control circuits 186 and 188 convert the input voltage to several DC voltages required therein to power an internal relay and a remote LED. The various voltages required in abrading unit 14 are transmitted thereto from power unit 12 via cable 18.

Rectifier 182 is typically a model CP-500, manufactured by Electroid of Springfield, N.J. Relay 184 is a conventional 90 volt DC relay having a normally-closed switch. Control circuits 186 and 188 are the R40 series, produced by Skan-a-Matic Corp. of Elbridge, N.Y.

Prior to placing abrading unit 14 in a bathtub, ball reversal screw 122 is manually rotated to position head 38 at approximately the mid-point of its traverse. This is performed to assure that the abrading process will begin in the traverse mode. As previously described, the process starts with head 38 stationed above the unperforated area at the left end of the template; the right scanner is detecting reflected light, and the left scanner is centered above a dark area in the left margin. In the traverse mode, a positive DC current flows from terminal 7 of rectifier 182 through both the normally-closed right and left traverse limit switches 160 and 162, respectively, which have their normally-closed terminals commonly connected. (Path 208 leading therefrom and connecting to terminal 3 of rectifier 182 provides spark suppression). Current flows from normally-closed switches 160 and 162 via path 210 to terminal 8 of relay 184, passing through the normally-closed relay switch (terminal 8 to terminal 5) and then, via path 190, to brake 113 and traverse clutch 115. The circuit is completed to rectifier 182 via path 192.

Right and left photoelectric controls 186 and 188, respectively, each contain a normally-closed, relay-operated switch with switch connections provided at terminals 10 and 11 on the control housings. The right reflective scanner 166, connected to control 186, is comprised of an infrared (or visible) LED 200 and photodetector 204. The identical left scanner 168, connected to left control 188, contains LED 202 and photodetector 206. During operation, the controls continuously illuminate their scanner LED's. When this light beam is interrupted by an appropriate reflective surface, the reflected beam is sensed by the associated photodetector which generates an electrical signal that is amplified to actuate the internal relay, thus opening the relay switch between terminals 10 and 11.

If initial traverse is to the right, by design the machine will not advance at the end of the rightward travel. The right traverse limit switch will be actuated to its normally-open (N.O.) position connecting to path 194. This path leads to switch terminal 10 of the right-hand control 186. However, this relay switch is open since the right scanner 166 is receiving reflected light from the first reflective spot on the right margin of the template. The machine will remain on station, reverse direction of traverse and travel to the left. (It is to be noted that the closed left traverse limit switch 162 provides current to the traverse clutch and brake during the reversing interval).

At the end of the leftward traverse, the left traverse limit switch 162 is actuated to its normally-open (N.O.) position. Current flows, via path 196, to terminal 10 of the left photoelectric control 188. Since the machine was first positioned so that the left scanner 168 is above a dark area on the left margin, the relay-operated switch, terminals 10 and 11 on control 188, remains closed. Thus, current is provided through this switch to energize relay 184, opening its normally-closed switch (terminals 5 and 8) which de-energizes brake 113 and traverse clutch 115. Simultaneously, current is provided, via path 198, to engage the forward-drive clutch 114, which circuit is completed, via path 192, to rectifier 182. (The connection to terminal 8 of rectifier 182 provides spark suppression).

The abrading machine is in the travel mode. Forward travel is stopped with head 38 in alignment with the first lateral row of holes when left scanner 168 detects the first reflective spot on the left margin. In this action, the reflected light triggers the internal relay in left control 188, opening the switch between control terminals 10 and 11. Thus, the forward-drive clutch 114 is disengaged; relay 184 is de-energized, which returns the relay switch to its normally-closed position. Closing of this relay switch provides current through the right traverse limit switch to initiate the traverse mode with current supplied, via paths 210 and 190, to energize brake 113 and traverse clutch 115.

Traverse direction is now synchronized with the right and left, photoelectrically-controlled switch positions. The abrading process continues with forward travel being controlled alternately by the right and left photo controls and scanners.

Upon completing the abrading of the last lateral row of template holes, the machine moves foward to a final station with head 38 positioned above an unperforated area at the right end of template 24. Further forward movement is prevented by a pair of laterally-aligned reflective spots, one in each margin. Reflected light signals are thus provided simultaneously to both photoelectric controls, opening their internal switches.

The present invention thus provides an abrading unit for abrading a surface in which the alignment with the perforations in the template is preserved and in which the abrading head is maintained normal to the bathtub surface at all times.

Although the preferred embodiments of the invention have been described in the foregoing Description of the Preferred Embodiments and illustrated in the accompanying Drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

I claim:

1. Apparatus for permitting selective abrading of the surface to be adhered by a stream of abrasive particles, comprising:

a template formed of particle impervious material adapted to be disposed over the surface to be abraded, said template containing a plurality of perforations for exposing selected areas of the surface to be abraded; and the margins of said template containing reflecting areas corresponding to rows of perforations to abraded, wherein the template is used with an abrading unit which is movable in a forward direction over the template, the abrading unit including an abrading head for movement between first and second limits along a direction transverse the forward direction, the stream of abrasive particles issuing from the abrading head, said template haivng a reflecting area corresponding to each row of perforations in the template, the abrading unit having a sensor for sensing the proximity of a reflecting area, the abrading unit moving the forward direction until the sensor detects the proximity of a reflecting area, whereupon the motion of the abrading unit in the forward direction is halted and the abrading head is moved between the first and second limits in the transverse direction to abrade the portions of the surface to be abraded that are exposed by the row of perforations in the template corresponding to the reflecting area.

2. The apparatus of claim 1, wherein the template further has at least one reflecting area positioned to cause the abrading head of the abrading unit to traverse at least a portion of the distance between the first and second limits along the transverse direction to permit the abrasive particle stream to develop a steady state prior to abrading the surface to be abraded.

3. The apparatus of claim 1, wherein the template further has at least one reflecting area positioned to halt the forward motion of the abrading unit after the abrading of the surface to be abraded is complete.

4. Apparatus for permitting selective abrading of a surface to be abraded by a stream of abrasive particles, comprising:

a template formes of particle impervious material adapted to be disposed over the surface to be abraded, said template containing a plurality of perforations for exposing selected areas of the surface to be abraded; and the margins of said template containing reflecting areas corresponding to rows of perforations to be abraded, wherein the template has a first margin and a second margin positioned on opposite sides of the rows of perforation, the margins extending along a forward direction and each of the rows of perforations extending along a direction transverse the forward direction, the reflecting areas lying on the first and second margin, wherein selected ones of said reflecting areas each correspond to a row of perforations and the selected ones of said reflecting areas are positioned on the template on an alternately staggered fashion on the first and second margins along the forward direction so that the area of the margin along the transverse direction from each of the selceted ones of the reflecting ones of the reflecting areas is nonreflecting.

5. The apparatus of claim 4, further including a reflecting area on the margin along the transverse direction from the last of the selected ones of the reflecting areas in the forward direction.

6. The apparatus of claim 4, further including at least one reflecting area on the margin not having the first of the selected ones of the reflecting areas in the forward direction and spaced in the direction opposite the forward direction from the first of the selected ones of the reflecting area.

7. A template for use with an abrading unit for generating a stream of abrasive particles, the template being formed of a material resistent to particle impact and being flexible to conform to the surface to be abraded, said template adapted to be disposed on the surface to be abraded, said template containing a plurality of perforations for exposimg selected areas of the surface to be abraded to the stream of abrasive particles, the perforations defining one or more groups of perforations, said template defining first and second margins extending along a forward direction with the perforation lying between the first and second margins, each of said groups lying along a line generally transverse the forward direction, said template further having an indicator positioned at one of said first and second margins corresponding to each group of perforations, said abrading unit being adapted to travel in the forward direction relative to the template and having a carriage movable in the transverse direction relative to the template, said abrading unit having an abrading head mounted for movement with the carriage for directing the particle stream toward the surface to be abraded, the carriage being movable between first and second limits along the transverse direction, the abrading unit having a first limit switch for activation upon movement of the carriage to the first limit and a second limit switch for activation upon movement of the carriage to the second limit, the abrading unit further having a first sensor corresponding to said first limit switch for sensing the proximity of an indicator on the first margin of the template and a second sensor corresponding to said second limit switch for sensing the proximity of an indicator along the second margin of the template, the abrading unit being positioned on the template for movement in the forward direction over the perforations on the template, the abrading unit moving in the forward direction only when a limit switch is activated and the corresponding sensor does not sense the proximity of a reflecting area, the carriage and abrading head being reciprocated between the first and second limits only when the abrading unit is not moving in the forward direction, the indicators on the template being positioned so that the abrading unit is moved in the forward direction with one of the limit switches activated until the proximity of an indicator is sensed by the corresponding scanner upon which event the abrading unit halts motion in the forward direction and the carriage abrading head moves along the transverse direction to abrade the surface to the abraded exposed by the group of perforations corresponding to the indicator sensed, movement of the carriage and abrading head to the opposite limit activating the opposite limit switch and moving the abrading unit forward until the corresponding scanner senses the proximity of another indicator to abrade the surface exposed by the group of perforations corresponding to the indicator so that the indicators on the template direct the abrading unit to move in the forward direction and abrade the surface exposed by the groups of perforations in a template.

8. The template of claim 7 further having a stop indicator opposite the last indicator corresponding to a group of perforation in the forward direction which lies along a line extending in the transverse direction from said last indicator to stop movement of the abrading unit in the forward direction upon completion of abrasion.

9. The template of claim 7 further having at least one positioning indicator on the margin opposite the first of the indicators corresponding to a gorup of perforations in the forward direction so that if the initiation of operation of the abrading unit has the carriage and abrading head moving away from the margin containing the first indicator, the positioning indicator will cause the machine to position the carriage and abrading head proximate the margin containing the first indicator when the corresponding scanner senses the proximity of the first indicator to stop the abrading unit and cause the carriage and abrading head to move in the transverse direction to abrade the surface exposed by the group of perforations corresponding to the first reflecting area.

10. The apparatus of claim 9 whereby the indicators are positioned in an alternately staggered fashion on first and second margins of the template, the margins extending along a first direction with the groups of perforations between the first and second margins, the spacing between adjacent indicators in the first direction being equal to the spacing between the corresponding groups of perforations in the template.

11. The apparatus of claim 10 further consisting of at least one indicator positioned on the margin opposite the margin containing the first of the indicators corresponding to a group of perforations in the forward direction for permitting an abrading unit to be positioned to abrade the group of perforations corresponding to the first indicator.

12. The apparatus of claim 10 further consisting of an indicator positioned directly opposite the last of the indicators corresponding to a group of perforations in the forward direction to stop the movement of an abrading unit in the forward direction upon completion of the abrasion.

* * * * *

UNITED STATES PATENT AND TRADEMARK OFFICE

CERTIFICATE OF CORRECTION

PATENT NO. : 4,671,022

DATED : June 9, 1987

INVENTOR(S) : David R. Williams

It is certified that error appears in the above-identified patent and that said Letters Patent is hereby corrected as shown below:

Column 11, line 43, change "haivng" to --having--.

Column 12, line 1, change "formes" to --formed--.

Column 12, line 21, change "selceted" to --selected--.

Column 12, line 39, change "exposimg" to --exposing--.

Column 13, line 26, change "perforation" to --perforations--.

Column 13, line 32, change "gorup" to --group--.

Signed and Sealed this

Nineteenth Day of July, 1988

*Attest:*

DONALD J. QUIGG

*Attesting Officer*

*Commissioner of Patents and Trademarks*